US006332664B1

(12) United States Patent
Kanazawa

(10) Patent No.: US 6,332,664 B1
(45) Date of Patent: Dec. 25, 2001

(54) LIGHT SHIELDING PROVIDED ALONG A PAPER FEED PATH OF A RECORDING APPARATUS

(75) Inventor: Manabu Kanazawa, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/384,425

(22) Filed: Aug. 27, 1999

(30) Foreign Application Priority Data

Aug. 31, 1998 (JP) ..... 10-245473

(51) Int. Cl.[7] ..... B41J 2/01
(52) U.S. Cl. ..... 347/19; 347/104
(58) Field of Search ..... 347/19, 3, 104; 358/472; 400/713

(56) References Cited

U.S. PATENT DOCUMENTS 5,168,291 * 12/1992 Hiramatsu et al. ..... 347/19
5,975,674 * 11/1999 Beauchamp et al. ..... 347/19
6,172,690 * 1/2001 Angulo et al. ..... 347/19

* cited by examiner

*Primary Examiner*—Craig A. Hallacher
(74) *Attorney, Agent, or Firm*—Fitzpatrick, Cella, Harper & Scinto

(57) ABSTRACT

A recording apparatus for performing a recording operation to a recording medium, conveyed by a conveyor, by using ink jet heads, and comprising an optical detector, arranged within the recording apparatus, for optically detecting desirable information and light-shielding for preventing light entering the interior of the recording apparatus from reaching the optical detector.

7 Claims, 8 Drawing Sheets

LIGHT SHIELDING PROVIDED ALONG A PAPER FEED PATH OF A RECORDING APPARATUS

BACKGROUND OF THE INVENTION

1. Field of the Invention

The present invention relates to a recording apparatus for recording an image to a recording medium and having an optical type detecting means within this recording apparatus.

2. Related Background Art

FIG. 6 is a perspective view showing the schematic construction of a conventional recording apparatus.

In FIG. 6, reference numeral 101 designates an ink tank of each color. Each ink tank is exchangeably mounted to a carriage 102. A recording head (not shown) for recording or printing an image to a recording medium (not shown)is arranged in the carriage 102. The image is recorded to the recording medium in accordance with a recording signal transmitted from an unillustrated substrate through an unillustrated flexible cable. Plural patterns showing information corresponding to a shifting amount of a printing position are printed to the recording medium by the recording head so as to relatively align the printing position at a first printing time to the recording medium with a printing position at a second printing time.

The recording apparatus shown in FIG. 6 is a so-called serial type printer. The carriage 102 is guided and supported so as to freely reciprocate in the direction of an arrow A along a guide shaft (not shown) arranged in a chassis 108. The carriage 102 is operated and controlled in position and movement by a driving mechanism such as a carriage motor (not shown), a motor pulley (not shown), a driven pulley 106, a timing belt 107, etc.

The recording medium such as a sheet of recording paper, etc. is fed by a paper feeder 110 until a nipping position of a conveying roller 111 and a pinch roller 113 within a body of the recording apparatus. The pinch roller 113 is held by a pinch roller holder 112. The pinch roller holder 112 is held by a pinch roller holder attaching plate 109 fastened and fixed to the chassis 108 by vises, etc. The pinch roller 113 comes in press contact with the conveying roller 111 by a pressing member such as a spring, etc. The recording medium conveyed to the above nipping position is further conveyed by the conveying roller 111 rotated by a driving mechanism (not shown).

Reference numeral 130 designates an optical type sensor of a reflection type as an optical detecting means mounted to the carriage 102. The optical type sensor 130 detects a printing pattern of the recording medium conveyed onto a platen 114 by scanning the carriage 102 in the direction of the arrow A. The optical type sensor 130 has a light emitting portion and a light receiving portion. Light emitted from the light emitting portion is reflected on a surface of the recording medium and the reflected light is detected by the light receiving portion.

A density of the pattern is detected by utilizing that intensity of the reflected light is changed in accordance with the density of the pattern printed on the recording medium.

However, in the prior art explained above, a problem exists in that external light enters the interior of the recording apparatus and no optical type sensor is normally operated in a certain case.

FIG. 7 is a cross-sectional view showing a conveying path of the recording medium in the conventional recording apparatus shown in FIG. 6.

In FIG. 7, reference numeral 116 designates the recording medium and shows a state in which the recording medium 116 is conveyed by the paper feeder 110. Reference numeral 115 designates a paper feed plate for guiding the recording medium 116 conveyed by the paper feeder 110 until the conveying roller 111.

Since the recording medium 116 stacked in the paper feeder 110 is arranged outside the recording apparatus body, the recording medium 116 is exposed to external light 117. Further, since the recording medium 116 is normally formed by a white color system, the external light 117 is well reflected on the recording medium 116. Accordingly, as shown in FIG. 7, the external light 117 is guided into the recording apparatus by the recording medium 116.

Further, since no member for pressing the recording medium 116 is arranged between the pinch roller holder 112 and the paper feed plate 115, there is a case in which the recording medium 116 is floated upward as shown by a dotted line in FIG. 7. In recent years, a high accuracy of about ±10 $\mu$m is also required in conveyance of the recording medium. However, when the recording medium is floated upward as mentioned above, a conveying position is correspondingly shifted so that conveying accuracy is reduced.

FIG. 8 is a perspective view showing a conveying path of the recording medium shown in FIG. 7.

As shown in FIG. 8, plural pinch roller holders 112 are arranged in parallel with each other in a transversal one line in the conventional recording apparatus. However, since there is a clearance B between the respective pinch roller holders 112, the external light 117 is leaked from this clearance B and further enters the platen 114 (see FIGS. 6 and 7).

As mentioned above, the optical type sensor 130 detects the density of the pattern by intensity of the reflected light from the pattern printed on the reflected light from the pattern printed on the recording medium 116 conveyed onto the platen 114. However, when the external light 117 further enters the recording medium 116 on the platen 114, no reflected light of the optical type sensor 130 can be exactly detected by an influence of this external light 117 so that no density of the pattern can be exactly detected.

SUMMARY OF THE INVENTION

An object of the present invention is to provide a recording apparatus for performing a recording operation to a recording medium conveyed by conveying means by using recording means, and comprising optical detecting means for optically detecting desirable information and arranged within the recording apparatus; and light-shielding means for preventing light entering the interior of said recording apparatus from reaching said optical detecting means.

Another object of the present invention is to provide a recording apparatus able to stably operate the optical detecting means since a fear of an error in operation of the optical detecting means caused by light entering the interior of the recording apparatus is restrained.

DETAILED DESCRIPTION OF THE PREFERRED EMBODIMENTS

The embodiments of the present invention will next be explained with reference to the drawings.

(First Embodiment)

Figure 1:
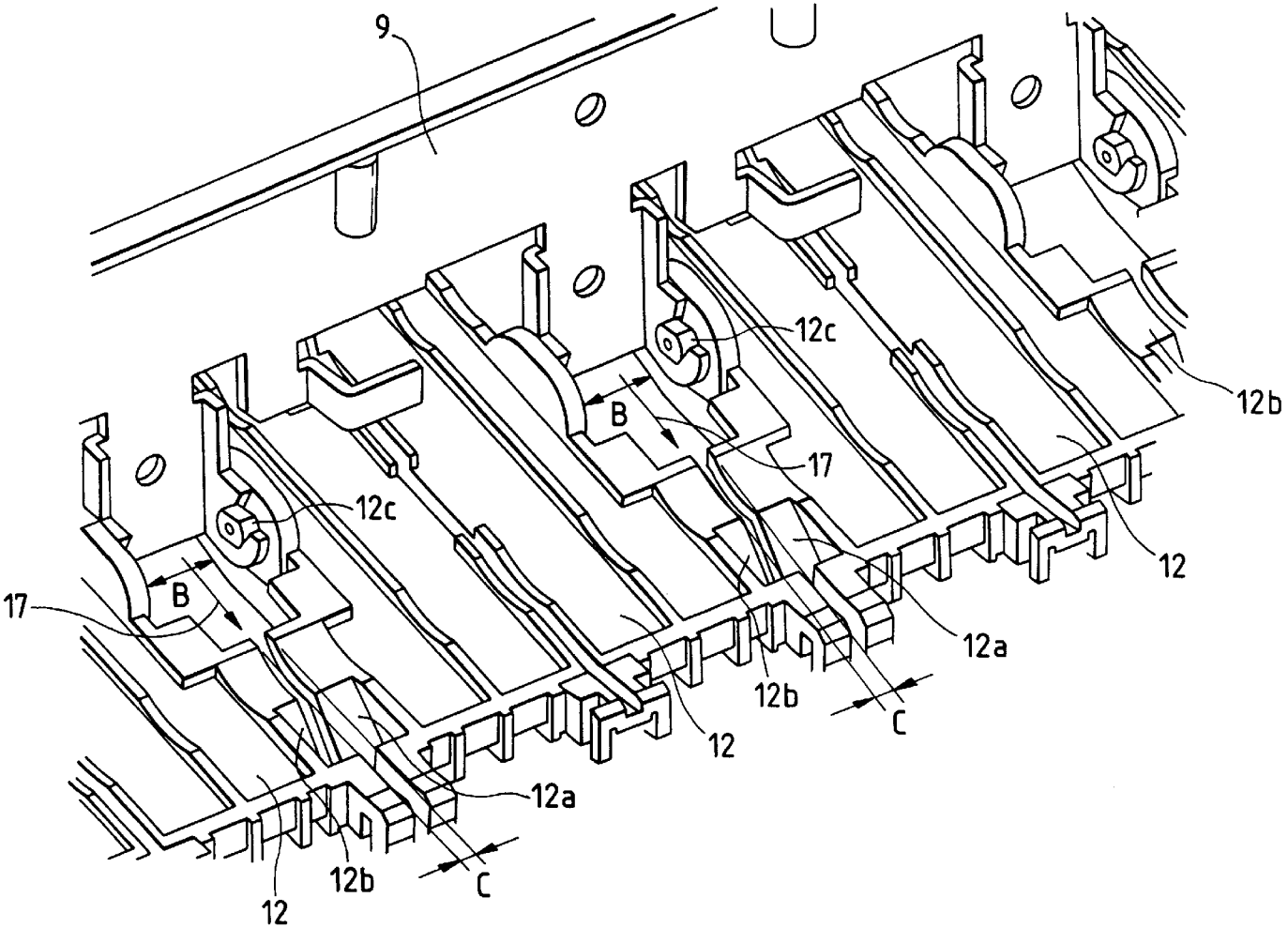
FIG. 1 is a perspective view showing a conveying path of a recording medium in a first embodiment of a recording apparatus of the present invention.
Figure 2:
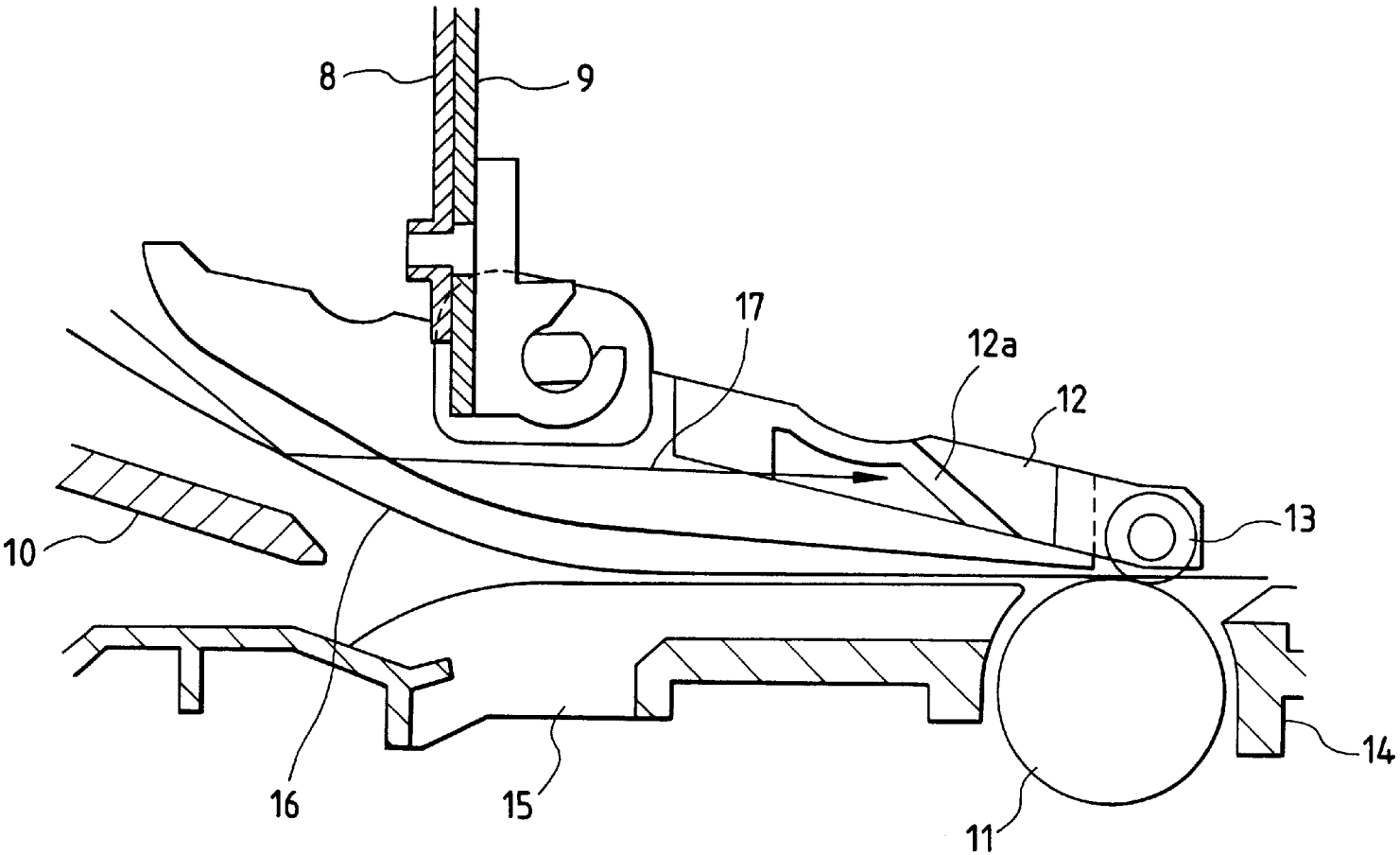
FIG. 2 is a cross-sectional view of the conveying path shown in FIG. 1.

FIG. 1 is a perspective view showing a conveying path of a recording medium in a first embodiment of a recording apparatus of the present invention. FIG. 2 is a cross-sectional view of the conveying path shown in FIG. 1.

Figure 6:
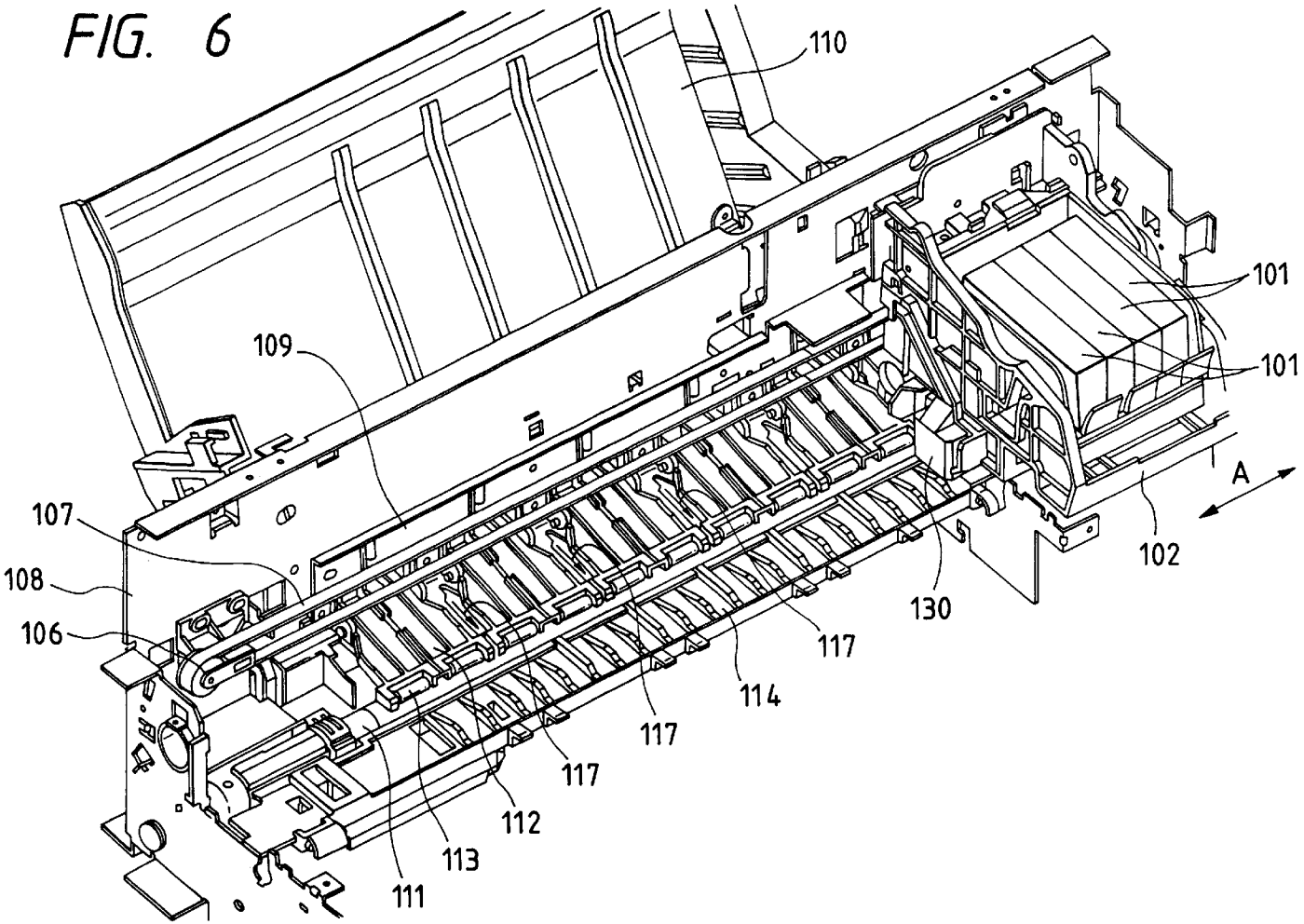
FIG. 6 is a perspective view showing the schematic construction of a conventional recording apparatus.

Each of constructions of an ink tank, a recording head as a recording means, a carriage, a driven pulley, a timing belt, a chassis 8, a pinch roller holder attaching plate 9, a paper feeder 10, a conveying roller 11, a pinch roller 13, a platen 14, a paper feed plate 15 and an optical type sensor as an optical detecting means in this embodiment is similar to that in the conventional recording apparatus shown in FIG. 6, etc. Accordingly, a detailed explanation of these constructions is omitted here. Further, similar to the prior art, a pattern showing information corresponding to a shifting amount between a printing position at a first printing time to the recording medium 16 and a printing position at a second printing time is printed to the recording medium 16.

As shown in FIG. 1, each of plural pinch roller holders 12 is pivotally mounted to the pinch roller attaching plate 9 by a rotating shaft 12*c* and holds the pinch roller 13 (see FIG. 2) and makes the pinch roller 13 come in press-contact with the conveying roller 11 by a pressing member such as a spring, etc.(see FIG. 2). A conveying means for conveying the recording medium 16 (see FIG. 2) is constructed by the conveying roller 11, the pinch roller 13 and the pinch roller holders 12.

Each of the pinch roller holders 12 is arranged in a state in which the pinch roller holders 12 are arranged in a line in a direction perpendicular to a conveying direction of the recording medium 16. Light-shielding walls 12*a*, 12*b* as a light-shielding means for shielding external light 17 (see FIG. 2) entering the interior of the recording apparatus are respectively arranged as light-shielding portions of the pinch roller holders in both side portions of each of the pinch roller holders 12. The clearance C between the light-shielding walls 12*a* and 12*b* adjacent to each other is formed such that the clearance C is narrower than the clearance B between the pinch roller holders 12 adjacent to each other.

Figure 7:
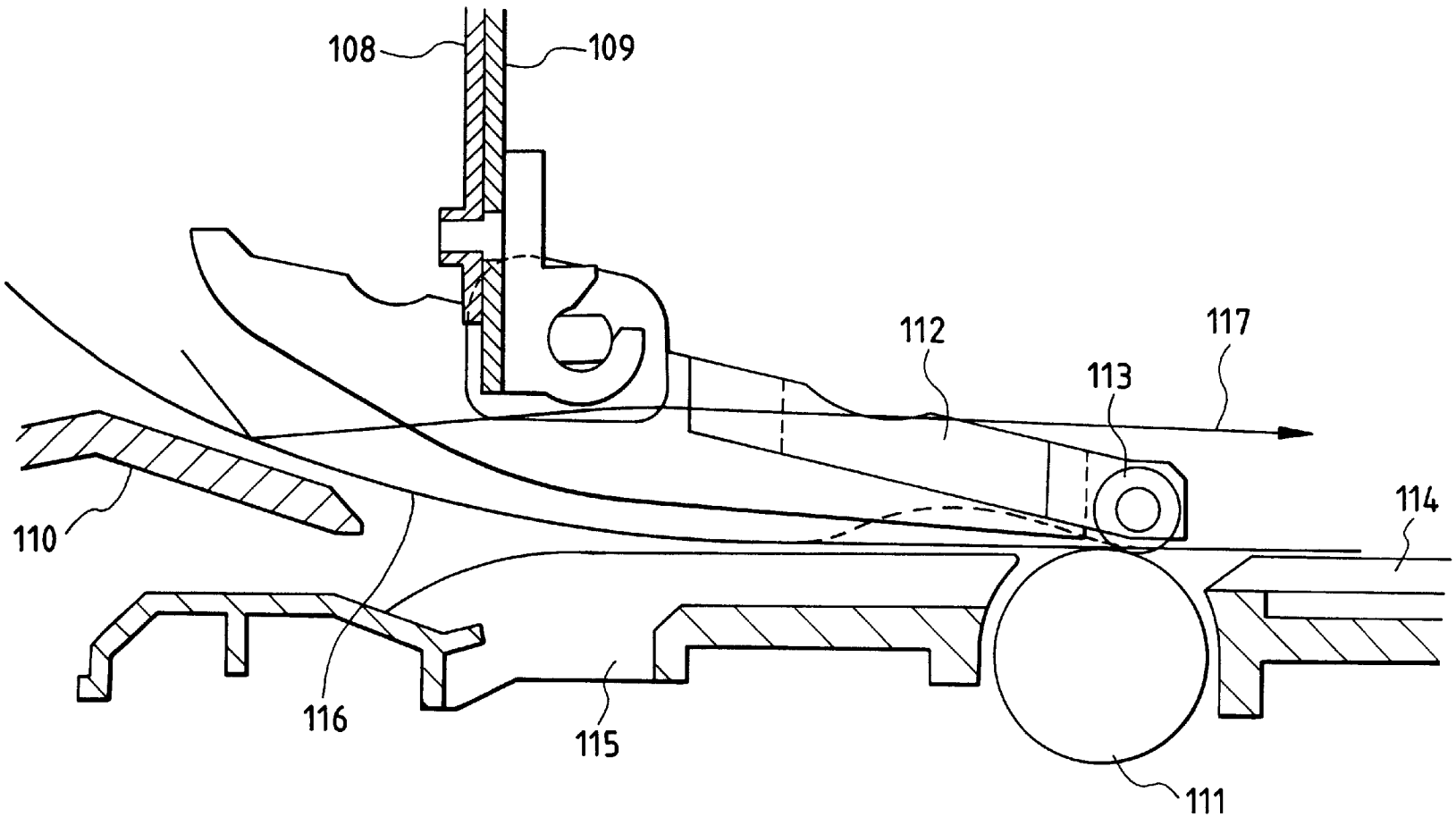
FIG. 7 is a cross-sectional view showing a conveying path of a recording medium in the conventional recording apparatus shown in FIG. 6.
Figure 8:
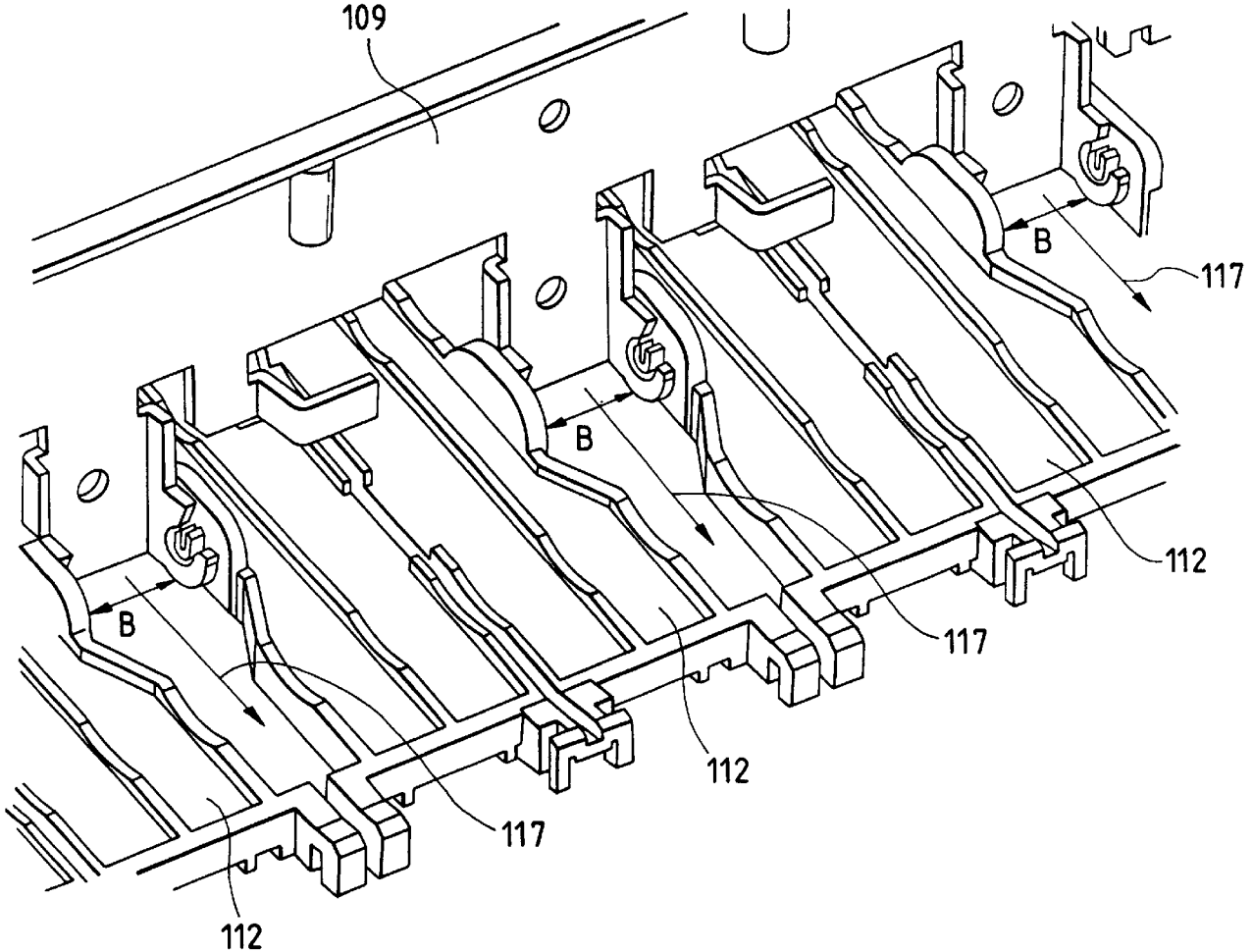
FIG. 8 is a perspective view showing the conveying path of the recording medium shown in FIG. 7.

With reference to FIG. 2, similar to the prior art explained by using FIG. 7, etc., the external light 17 is reflected on the recording medium 16 stacked to the paper feeder 10 and enters the interior of the recording apparatus. The external light 17 enters the interior of the recording apparatus through lower sides of the chassis 8 and the pinch roller holder attaching plate 9. Further, while the external light 17 is alternately reflected between the recording medium 16 and the pinch roller holders 12, the external light 17 is advanced toward a platen (not shown). However, since the external light 17 is shielded by the light-shielding walls 12*a*, 12*b* arranged in each of the pinch roller holders 12, an amount of the external light 17 reaching the platen can be reduced.

Accordingly, the external light 17 reaching an optical type sensor (not shown) for detecting a printing pattern printed on the recording medium 16 conveyed onto the platen as an image recording area by a recording head is reduced. Therefore, a fear of the generation of an error in operation of the optical type sensor caused by the external light 17 is restrained so that the optical type sensor can be stably operated.

When the light-shielding walls 12*a*, 12*b* are formed integrally with the pinch roller holders 12, the light-shielding walls 12*a*, 12*b* can be arranged by only changing shapes of the conventional pinch roller holders without increasing the number of parts of the recording apparatus. Further, the respective pinch roller holders 12 are preferably formed in the same shape.

A so-called ink jet recording head for forming an image to the recording medium 16 by injecting ink from a nozzle may be used in the above recording head.

In the above example, a pattern displaying information corresponding to a shifting amount of the printing position printed to the recording medium 16 is detected by the optical type sensor. However, a detecting object of the optical type sensor is not limited to such a pattern, but may be also another arbitrary information able to be optically detected.

(Second Embodiment)

As explained with reference to FIG. 1, etc., the amount of the external light 17 entering the platen is considerably reduced by the light-shielding walls 12*a*, 12*b* arranged in the pinch roller holders 12 in the recording apparatus in the first embodiment. However, since the clearance C is formed between the respective pinch roller holders 12, the external light 17 slightly passes through the clearance C and it is impossible to perfectly prevent the external light 17 from entering the platen. In this embodiment, the advancement of this slight external light onto the platen is also shielded.

Figure 3:
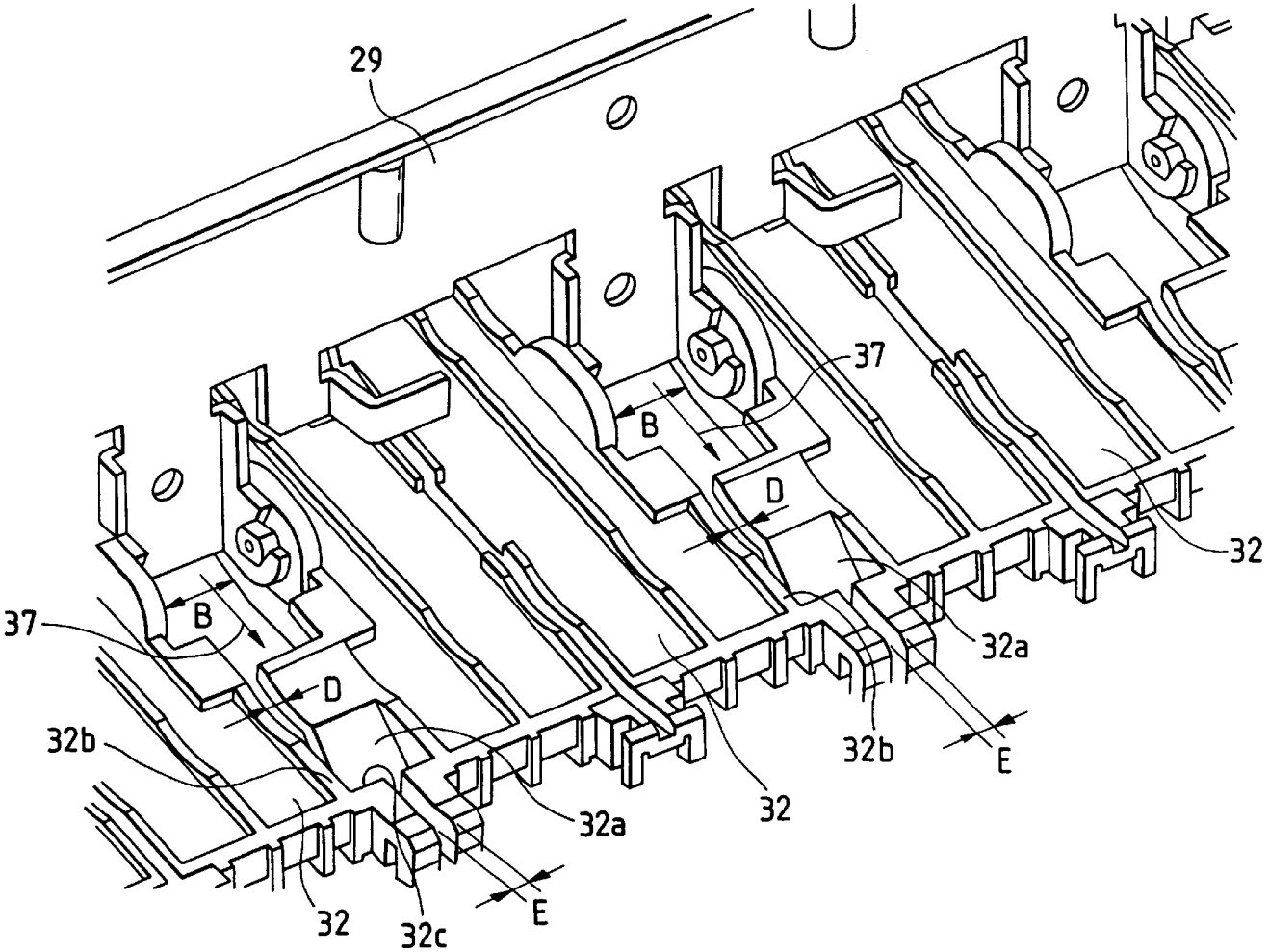
FIG. 3 is a perspective view showing a conveying path of a recording medium in a second embodiment of the recording apparatus of the present invention.
Figure 4:
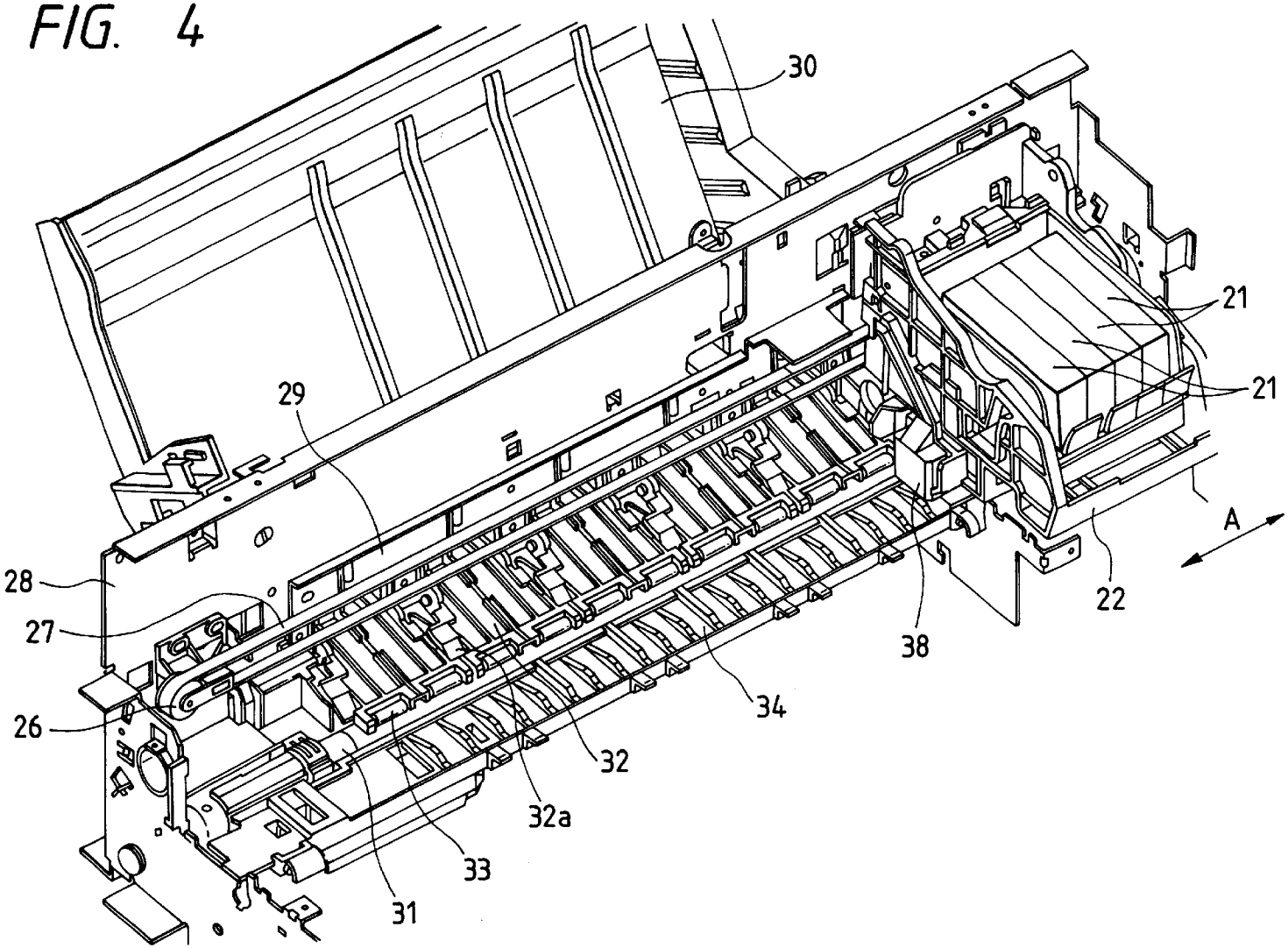
FIG. 4 is a perspective view showing a schematic construction of the second embodiment of the recording apparatus of the present invention.

FIG. 3 is a perspective view showing a conveying path of a recording medium in a second embodiment of the recording apparatus of the present invention. FIG. 4 is a perspective view showing a schematic construction of the second embodiment of the recording apparatus of the present invention.

Each of constructions of an ink tank 21, a carriage 22, a driven pulley 26, a timing belt 27, a chassis 28, a pinch roller holder attaching plate 29, a paper feeder 30, a conveying roller 31, a pinch roller 33, a platen 34, a paper feed plate, an optical type sensor 38 and a recording medium 36 in this embodiment is similar to that in the conventional recording apparatus shown in FIG. 6, etc. Accordingly, a detailed explanation of these constructions is omitted here.

As shown in FIG. 3, a light-shielding wall 32*a* is integrally formed on a left-hand side face of each pinch roller holder 32. A clearance D is formed between the light-shielding wall 32*a* and a right-hand side face 32*b* of a pinch roller holder 32 adjacent to the pinch roller holder 32 forming the light-shielding wall 32*a* therein. A clearance E is formed between the pinch roller holders 32 adjacent to each other. The clearance E is formed to avoid a mutual interference of operations of the respective pinch rollers 33, or to easily attach the pinch rollers 33 to the pinch roller holders 32. Each light-shielding wall 32*a* is arranged in a position relation overlapped with the clearance E in an advancing direction of the external light 37 entering the interior of the recording apparatus.

Thus, the external light 37 entering the interior of the recording apparatus is shielded by the light-shielding wall 32*a* and is further shielded by a front side wall 32*c* of each of the pinch roller holders 32 even when the external light 37 passes through the clearance D. Therefore, no external light 37 passes through the clearance E between the pinch roller holders 32.

Accordingly, the external light 37 is prevented from reaching the optical type sensor 38 for detecting a pattern printed to the recording medium 36 conveyed onto the platen so that the optical type sensor 38 can be more stably operated.

(Third Embodiment)

Figure 5:
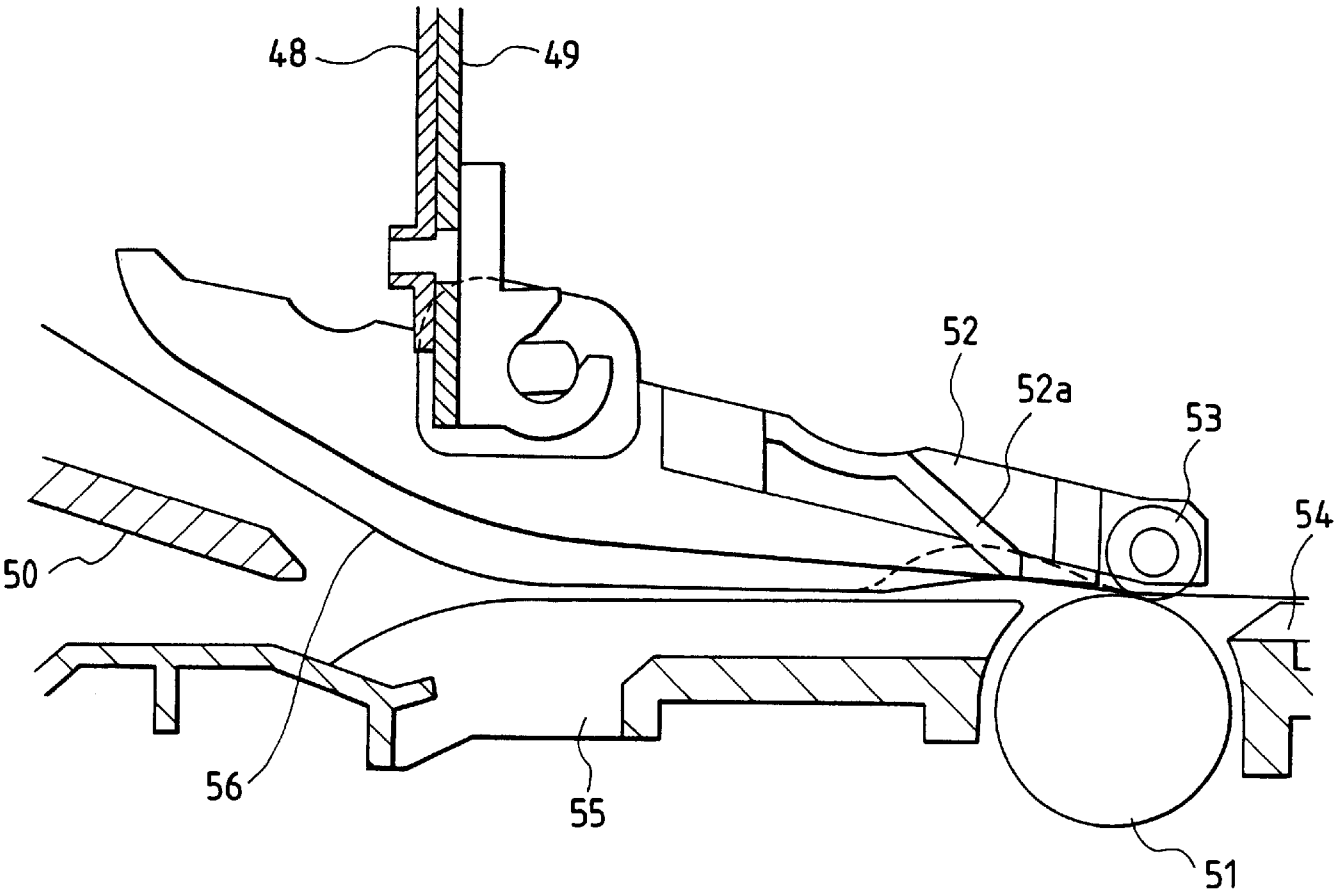
FIG. 5 is a cross-sectional view showing a conveying path of a recording medium in a third embodiment of the recording apparatus of the present invention.

FIG. 5 is a cross-sectional view showing a conveying path of a recording medium in a third embodiment of the recording apparatus of the present invention.

Each of constructions of an ink tank, a carriage, a driven pulley, a timing belt, a chassis 48, a pinch roller holder attaching plate 49, a paper feeder 50, a conveying roller 51, a pinch roller 53, a platen 54, a paper feed plate 55, an optical type sensor and a recording medium 56 in this embodiment is similar to that in the conventional recording apparatus shown in FIG. 6, etc. Accordingly, a detailed explanation of these constructions is omitted here.

Similar to the second embodiment shown in FIG. 3, a light-shielding wall 52*a* is integrally formed on a left-hand side face of each pinch roller holder 52 in this embodiment. However, the light-shielding wall 52*a* in this embodiment is constructed such that an end tip portion of the light-shielding wall 52*a* is located near a surface of the recording medium 56 conveyed between the pinch roller holder 52 and the paper feed plate 55.

Thus, it is prevented that the recording medium 56 is floated upward as shown by a dotted line in FIG. 5 between the pinch roller holder 52 and the paper feed plate 55. Accordingly, it is prevented that conveying accuracy of the recording medium is reduced.

As explained above, the recording apparatus in each of the present embodiments has a light-shielding means for preventing light entering the interior of the recording apparatus from reaching the optical detecting means so that the optical detecting means can be stably operated.

What is claimed is:

1. A recording apparatus for recording with a recording head on a recording medium conveyed by a roller, said apparatus comprising:

a plurality of roller holders provided adjacent to each other along a direction across a conveyance direction of the recording medium and having a holding portion for holding said roller;

an optical detecting element provided in the vicinity of a space in the recording apparatus where said recording head records on the recording medium to optically detect a desired information; and a light-shielding construction for preventing an external light from entering into an interior of the recording apparatus and from reaching said optical detecting element through and between adjacent roller holders, said light shielding construction being a light shielding surface provided on at least one wall surface of adjacent said roller holders opposed to each other to shield a route of said external light toward said optical detecting element.

2. The recording apparatus according to claim 1, wherein said at least one wall surface is formed integrally with each of said roller holders.

3. The recording apparatus according to claim 1, wherein each of said plural roller holders is formed in the same shape.

4. The recording apparatus according to claim 1, wherein said at least one wall surface and the clearance between said respective roller holders adjacent to each other are arranged such that the at least one wall surface and the clearance overlap each other in an advancing direction of light entering the interior of said recording apparatus.

5. The recording apparatus according to claim 1, wherein said at least one wall surface is constructed such that an end portion of the at least one wall surface is located in the vicinity of a surface of said recording medium.

6. The recording apparatus according to claim 1, wherein said information is information recorded to said recording medium by said recording means; and said optical detecting means is arranged such that said information is detected in the vicinity of a position in which an image is recorded by said recording means of said recording medium.

7. The recording apparatus according to any one of claims 1 and 2 to 6, wherein said recording means is an ink jet recording head for injecting ink from a nozzle and forming an image to said recording medium.

* * * * *